US005876097A

United States Patent [19]

Cao

[11] Patent Number: 5,876,097

[45] Date of Patent: Mar. 2, 1999

[54] ADJUSTABLE ARMREST DEVICE

[76] Inventor: Zi-Wen Cao, 58, Ma Yuan West St., Taichung, Taiwan

[21] Appl. No.: 119,226

[22] Filed: Jul. 20, 1998

[51] Int. Cl.[6] ..... A47C 7/54

[52] U.S. Cl. ..... 297/411.37; 297/411.35

[58] Field of Search ..... 297/411.2, 411.35, 297/411.37, 116, 411.3, 411.26, 411.38; 248/118

[56] References Cited

U.S. PATENT DOCUMENTS 5,484,187 1/1996 Doerner et al. .
5,590,934 1/1997 Gibbs .
5,597,208 1/1997 Bonutti .
5,641,203 6/1997 Van De Riet et al. .

*Primary Examiner*—Milton Nelson, Jr.

[57] ABSTRACT

An adjustable armrest device has a fixed seat, a main body covering an upper portion of the fixed seat, and an insert block disposed between the main body and the fixed seat. The fixed seat has two through apertures. The insert block has two stepped holes, two threaded apertures, and two upper grooves. The main body has a lower recess receiving the insert block, two threaded holes, a circular recess hole, a circular blind hole, two round recess holes, and two round blind holes. Two slide seats are inserted in the stepped holes. Each slide seat has a through hole receiving a threaded fastener. Two hollow cylinders are inserted in the upper grooves. Two bolts pass through the through apertures and the threaded apertures to fasten the fixed seat and the insert block together.

4 Claims, 5 Drawing Sheets

ADJUSTABLE ARMREST DEVICE

BACKGROUND OF THE INVENTION

The present invention relates to an adjustable armrest device. More particularly, the present invention relates to an adjustable armrest device for a chair or for a sofa.

A conventional chair has a fixed armrest which cannot be adjusted. Since the arm sizes of the users vary from one person to another person, the user may want to adjust the armrest of the chair in order to fit the arm size of the user. However, the conventional armrest does not have any adjustment function.

SUMMARY OF THE INVENTION

An object of the present invention is to provide an adjustable armrest device which can be adjusted easily.

Accordingly, an adjustable armrest device comprises a fixed seat, a main body covering an upper portion of the fixed seat, and an insert block disposed between the main body and the fixed seat. The fixed seat comprises a first through aperture and a second through aperture. The insert block comprises a first stepped hole, a second stepped hole, a first threaded aperture, a second threaded aperture, a first upper groove, and a second upper groove. The main body comprises a lower recess receiving the insert block, a first threaded hole, a second threaded hole, a circular recess hole, a circular blind hole, two round recess holes, and two round blind holes. A first slide seat is inserted in the first stepped hole. The first slide seat has a first through hole receiving a first threaded fastener. A second slide seat is inserted in the second stepped hole. The second slide seat has a second through hole receiving a second threaded fastener. A first hollow cylinder is inserted in the first upper groove. A first elastic spring and a first ball are inserted in the first hollow cylinder. A second hollow cylinder is inserted in the second upper groove. A second elastic spring and a second ball are inserted in the second hollow cylinder. The first threaded fastener is inserted through the first through hole of the first slide seat and inserted in the first threaded hole of the main body. The second threaded fastener is inserted through the second through hole of the second slide seat and inserted in the second threaded hole of the main body. A first bolt passes through the first through aperture and the first threaded aperture to fasten the fixed seat and the insert block together. A second bolt passes through the second through aperture and the second threaded aperture to fasten the fixed seat and the insert block together. The first ball is inserted in the circular recess hole of the main body. The second ball is inserted in the circular blind hole of the main body.

DETAILED DESCRIPTION OF THE INVENTION

Figure 1:
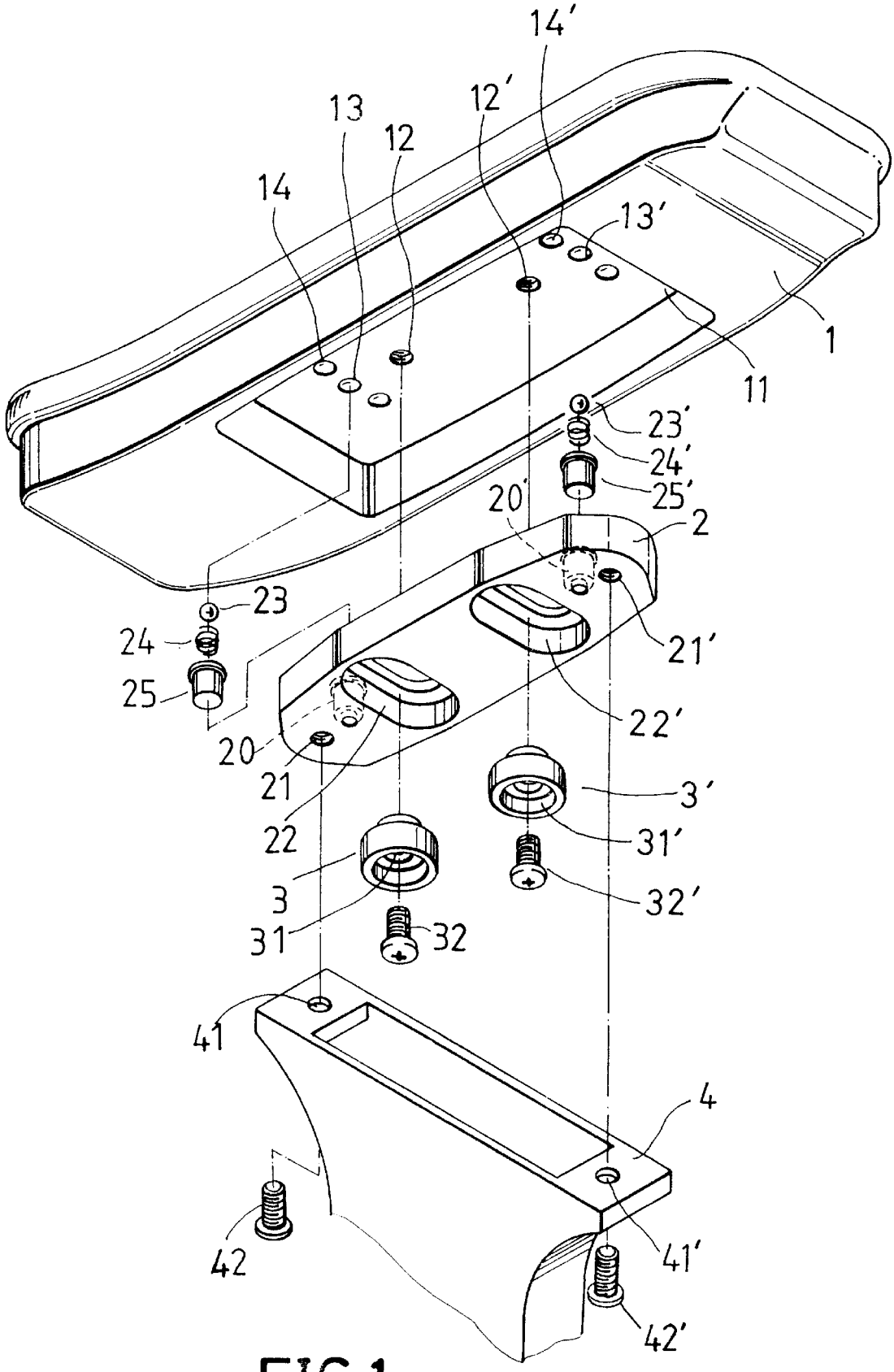
FIG. 1 is a perspective exploded view of an adjustable armrest device of a preferred embodiment in accordance with the present invention.
Figure 2:
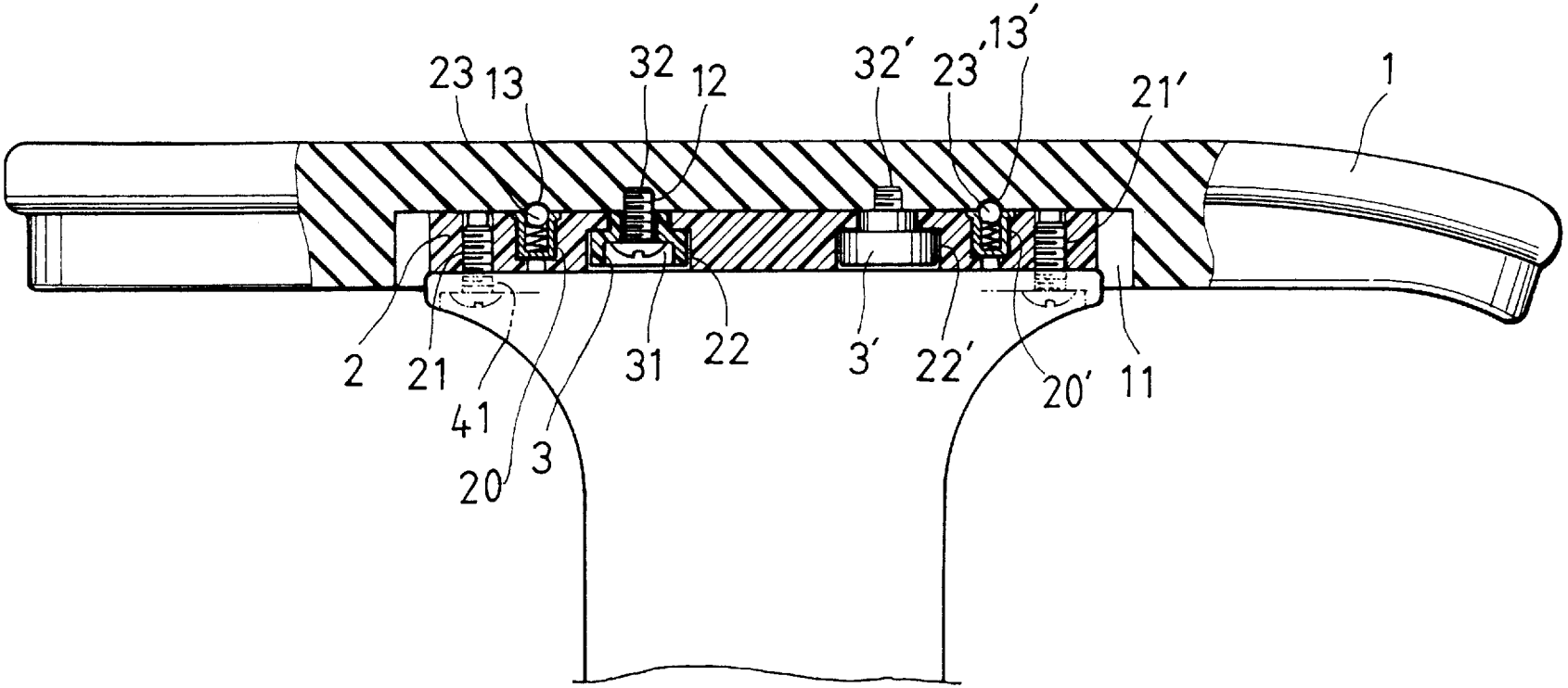
FIG. 2 is a sectional assembly view of an adjustable armrest device of a preferred embodiment in accordance with the present invention.
Figure 3:
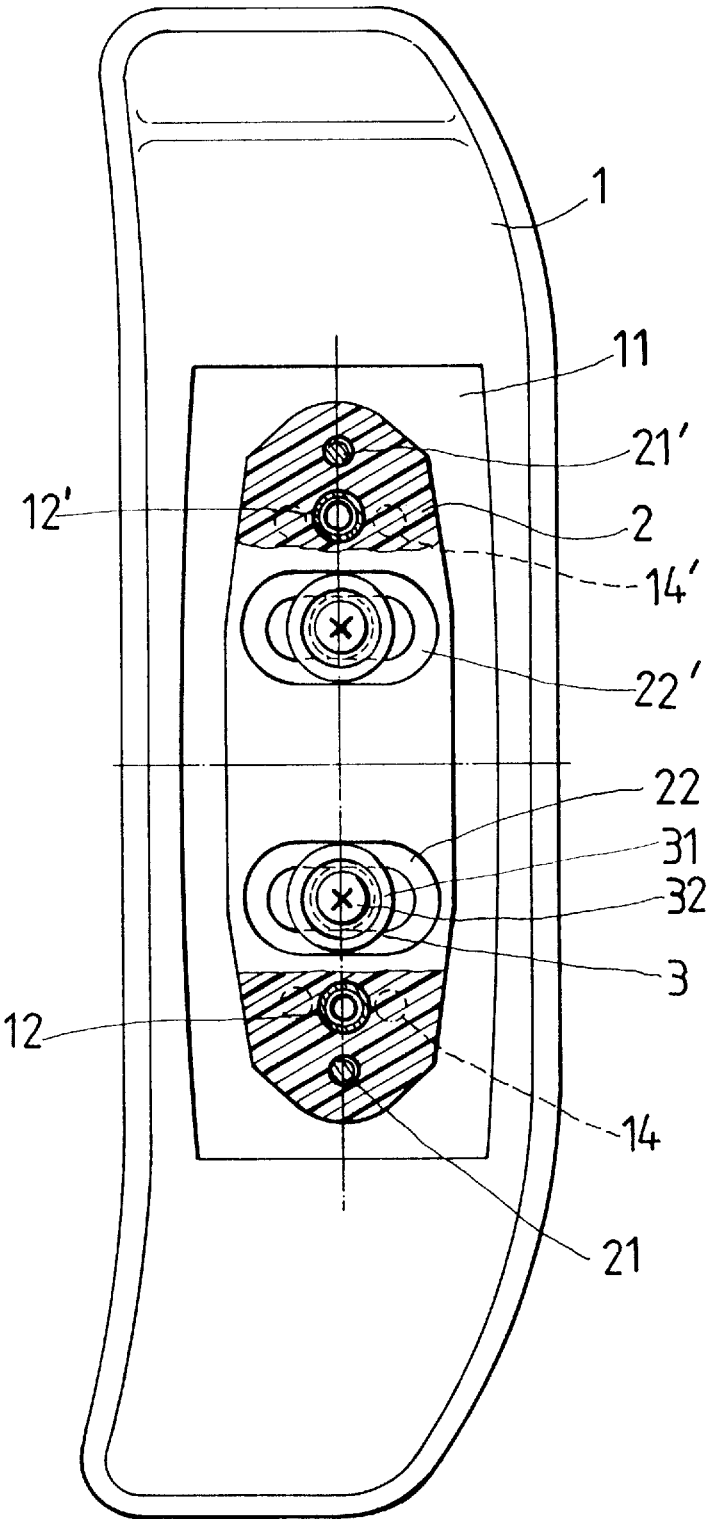
FIG. 3 is a partially sectional view of an adjustable armrest device of a preferred embodiment in accordance with the present invention.

Referring to FIGS. 1 to 3, an adjustable armrest device comprises a fixed seat 4, a main body 1 covering an upper portion of the fixed seat 4, and an insert block 2 disposed between the main body 1 and the fixed seat 4.

The fixed seat 4 comprises a first through aperture 41 and a second through aperture 41'.

The insert block 2 comprises a first stepped hole 22, a second stepped hole 22', a first threaded aperture 21, a second threaded aperture 21', a first upper groove 20, and a second upper groove 20'.

The main body 1 comprises a lower recess 11 receiving the insert block 2, a first threaded hole 12, a second threaded hole 12', a circular recess hole 13, a circular blind hole 13', two round recess holes 14, and two round blind holes 14'.

A first slide seat 3 is inserted in the first stepped hole 22. The first slide seat 3 has a first through hole 31 receiving a first threaded fastener 32. A second slide seat 3' is inserted in the second stepped hole 22'. The second slide seat 3' has a second through hole 31' receiving a second threaded fastener 32'. A first hollow cylinder 25 is inserted in the first upper groove 20. A first elastic spring 24 and a first ball 23 are inserted in the first hollow cylinder 25. A second hollow cylinder 25' is inserted in the second upper groove 20'. A second elastic spring 24 and a second ball 23' are inserted in the second hollow cylinder 25'. The first threaded fastener 32 is inserted through the first through hole 31 of the first slide seat 3 and inserted in the first threaded hole 12 of the main body 1. The second threaded fastener 32' is inserted through the second through hole 31' of the second slide seat 3' and inserted in the second threaded hole 12' of the main body 1. A first bolt 42 passes through the first through aperture 41 and the first threaded aperture 21 to fasten the fixed seat 4 and the insert block 2 together. A second bolt 42' passes through the second through aperture 41' and the second threaded aperture 21' to fasten the fixed seat 4 and the insert block 2 together. The first ball 23 is inserted in the circular recess hole 13 of the main body 1. The second ball 23' is inserted in the circular blind hole 13' of the main body 1. The fixed seat 4 is disposed on a chair. The first through hole 31 of the first slide seat 3 has a step shape. The second through hole 31' of the second slide seat 3' has a step shape.

Figure 4:
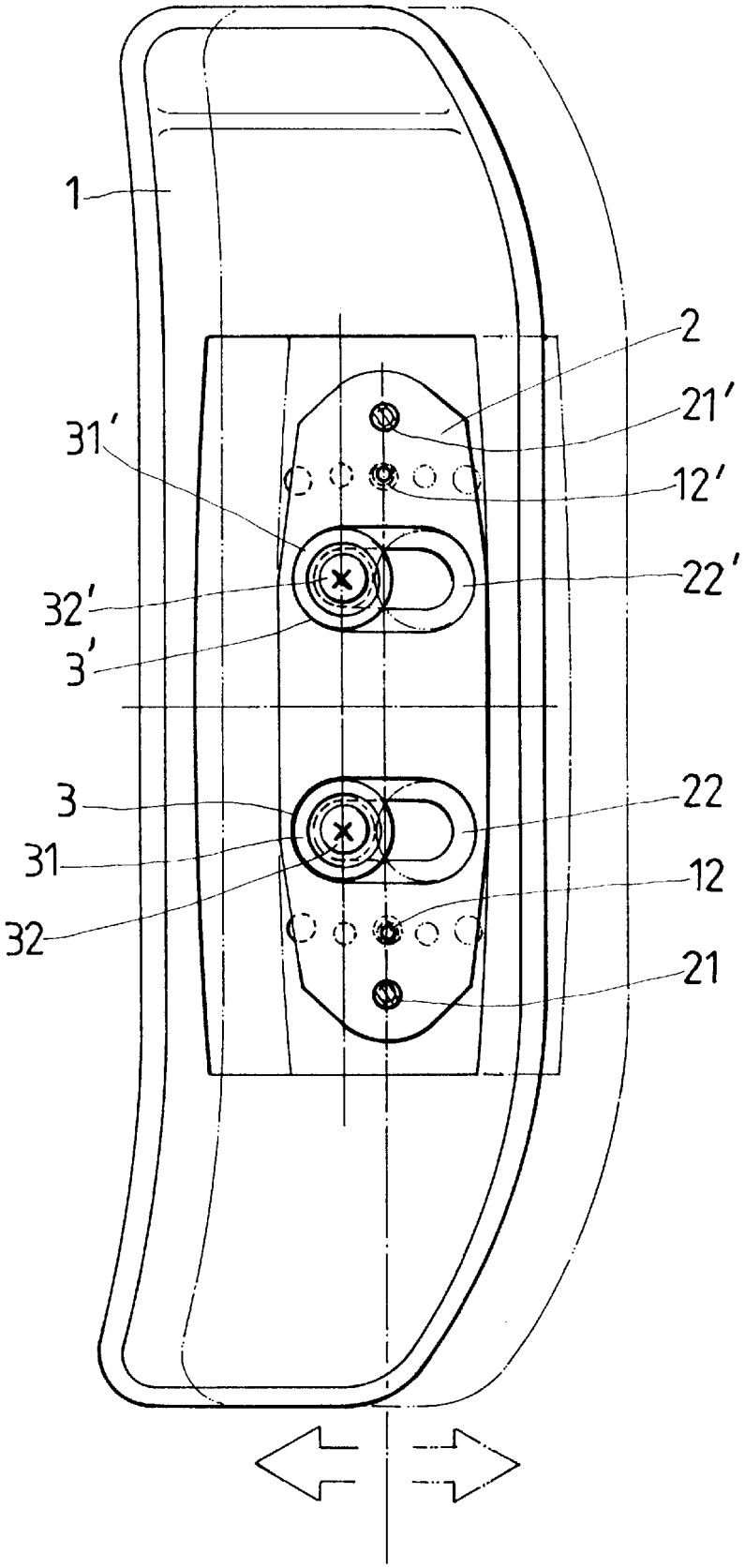
FIG. 4 is a schematic view illustrating an operation of an adjustable armrest device of a preferred embodiment in accordance with the present invention.

Referring to FIG. 4, the main body 1 can be pushed toward the chair or out of the chair. The first ball 23 will be departed from the circular recess hole 13 and inserted in one of the round recess holes 14. The second ball 23' will be departed from the circular blind hole 13' and inserted in one of the round blind holes 14'. Thus the first ball 23 and the second ball 23' will move in the same direction.

Figure 5:
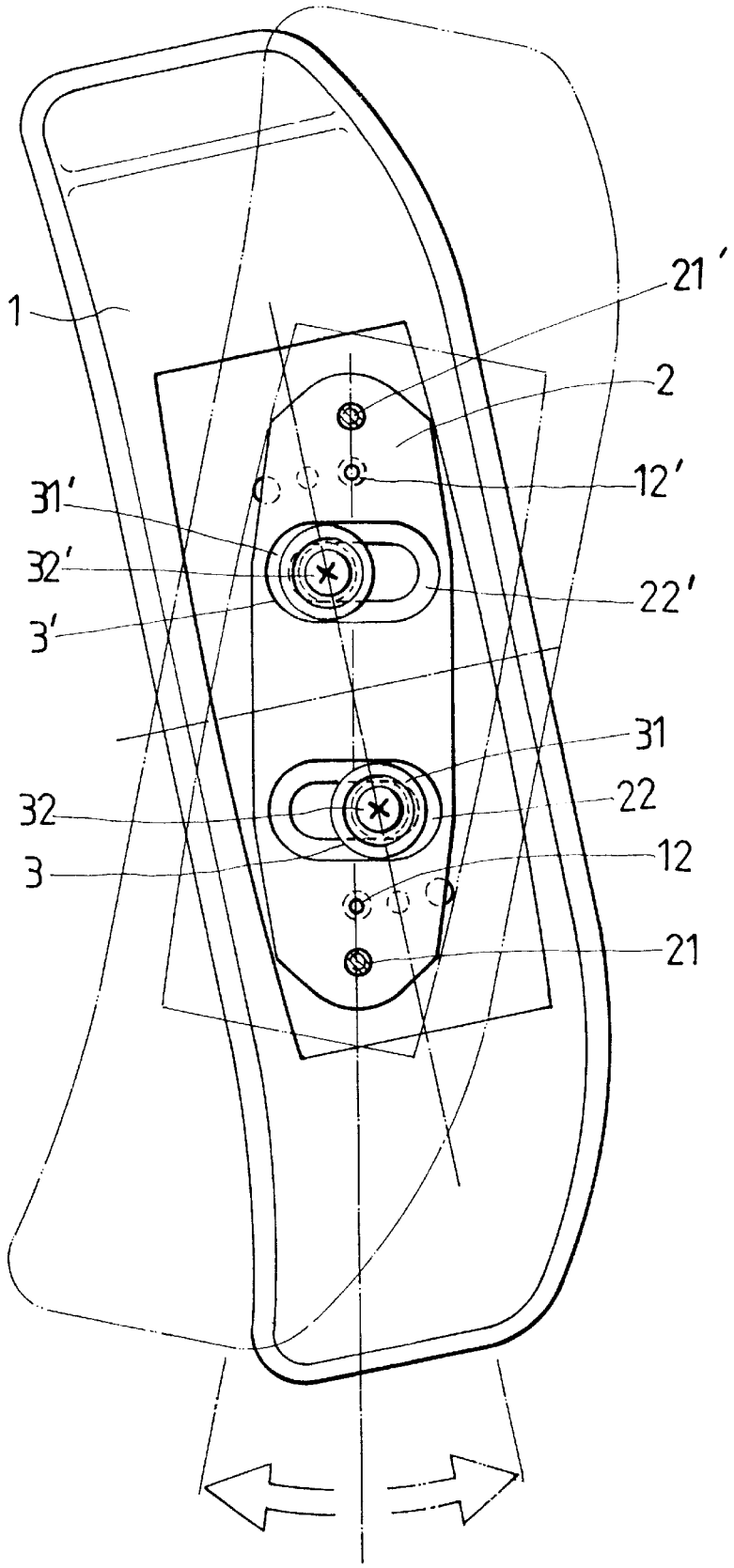
FIG. 5 is a schematic view illustrating another operation of an adjustable armrest device of a preferred embodiment in accordance with the present invention.

Referring to FIG. 5, one end of the main body 1 can be pushed toward the chair and the other end of the main body 1 can be pushed out of the chair. The first ball 23 and the second ball 23' will move in the opposite directions.

Therefore, the adjustable armrest device of the present invention can be adjusted easily.

The invention is not limited to the above embodiment but various modification thereof may be made. Further, various changes in form and detail may be made without departing from the scope of the invention.

I claim:

1. An adjustable armrest device comprising:

a fixed seat, a main body covering an upper portion of the fixed seat, an insert block disposed between the main body and the fixed seat, the fixed seat comprising a first through aperture and a second through aperture, the insert block comprising a first stepped hole, a second stepped hole, a first threaded aperture, a second threaded aperture, a first upper groove, and a second upper groove, the main body comprising a lower recess receiving the insert block, a first threaded hole, a second threaded hole, a circular recess hole, a circular blind hole, two round recess holes, and two round blind holes, a first slide seat inserted in the first stepped hole, the first slide seat having a first through hole receiving a first threaded fastener, a second slide seat inserted in the second stepped hole, the second slide seat having a second through hole receiving a second threaded fastener, a first hollow cylinder inserted in the first upper groove, a first elastic spring and a first ball inserted in the first hollow cylinder, a second hollow cylinder inserted in the second upper groove, a second elastic spring and a second ball inserted in the second hollow cylinder, the first threaded fastener inserted through the first through hole of the first slide seat and inserted in the first threaded hole of the main body, the second threaded fastener inserted through the second through hole of the second slide seat and inserted in the second threaded hole of the main body, a first bolt passing through the first through aperture and the first threaded aperture to fasten the fixed seat and the insert block together, a second bolt passing through the second through aperture and the second threaded aperture to fasten the fixed seat and the insert block together, the first ball inserted in the circular recess hole of the main body, and the second ball inserted in the circular blind hole of the main body.

2. An adjustable armrest device as claimed in claim 1, wherein the first through hole of the first slide seat has a step shape and the second through hole of the second slide seat has a step shape.

3. An adjustable armrest device as claimed in claim 1, wherein the first threaded fastener is a screw.

4. An adjustable armrest device as claimed in claim 1, wherein the second threaded fastener is a screw.

* * * * *